United States Patent [19]

Karashima

[11] Patent Number: 4,696,406

[45] Date of Patent: Sep. 29, 1987

[54] RACK BOARD

[76] Inventor: Masashi Karashima, 88-5, Nakano, Ebina-shi, Kanagawa-ken, Japan

[21] Appl. No.: 772,677

[22] Filed: Sep. 5, 1985

[30] Foreign Application Priority Data

Oct. 15, 1984 [JP] Japan ..... 59-214303

[51] Int. Cl.[4] ..... A47F 5/00

[52] U.S. Cl. ..... 211/153; 108/110; 403/345

[58] Field of Search ..... 211/153, 183, 186; 108/109, 110, 108; 403/345

[56] References Cited

U.S. PATENT DOCUMENTS

| | | | |
|---|---|---|---|
| 1,853,840 | 4/1932 | Bailey | 211/153 |
| 2,554,599 | 5/1951 | Stovern | 248/413 |
| 2,907,471 | 10/1959 | Henry | 108/109 |
| 3,100,572 | 8/1963 | Gingher et al. | 211/153 |
| 3,217,671 | 11/1965 | Walsh | 108/111 X |
| 3,323,656 | 6/1967 | Weiss et al. | 211/153 |
| 3,481,486 | 12/1969 | Squires | 211/153 |
| 3,556,309 | 1/1971 | Schreyer | 211/153 |
| 3,986,616 | 10/1976 | Gray | 211/153 |

FOREIGN PATENT DOCUMENTS

| | | | |
|---|---|---|---|
| 897637 | 4/1972 | Canada | 211/153 |

*Primary Examiner*—Ramon S. Britts
*Assistant Examiner*—Blair M. Johnson
*Attorney, Agent, or Firm*—Wenderoth, Lind & Ponack

[57] ABSTRACT

A rack board comprising a main horizontal plate and channel-type reinforcing members and plastic side covers is provided. The main horizontal plate is only cut off at the right and left end portions without forming bent brims there. The plastic side covers are attached to the cut off ends of the main horizontal plate to form the rack board. This arrangement enables the simplification of manufacturing process, the reduction of cost and the effective designing.

4 Claims, 7 Drawing Figures

RACK BOARD

BACKGROUND OF THE INVENTION

This invention relates to rack boards of display racks for supermarkets etc. and of other racks in general.

With respect to conventional metal rack boards, a main rack board comprises bent portions on both end brims of the right and left sides as well as on both end brims of the front. This the rear and is disadvantageous because of the amount of work required in bending and welding brims of the board to form the bent portions, especially when the board is fabricated from stainless steel.

This invention has been provided for the purpose of eliminating this disadvantage and relates to rack boards characterized by a metal main rack board including a main horizontal plate with both the right and left ends cut off and has vertical bent portions formed on the front and rear end brims channel-type reinforcing members extend to the right and to the left and one disposed on the bottom. Plastic side covers have upper and lower horizontal portions respectively extending from upper and lower end brims of a vertical portion of the side cover. Side bracket portions extend from front and rear brims of the vertical portion, and channel-type bracket portions and vertical ribs project from and extend between the vertical portion and the lower horizontal portion. The side bracket portions, channel-type bracket portions and vertical ribs are arranged so as to define gaps between the upper horizontal portion and the respective upper end brims of the side bracket portions, the channel-type bracket portions and the ribs, wherein the above cut off end of the horizontal plate of the main rack board and the channel-type reinforcing members are fittingly set. The main rack board is also set in the channel-type bracket portions of the side cover, the front and rear vertical bent portions of the main rack board being held by the lower horizontal portion, and the channel-type bracket portions and the front and rear bracket portions respectively being fixed to the channel-type reinforcing members and the front and rear vertical bent portions of the main rack board.

According to the invention, as set forth above, the right and left end portions of the main horizontal plate of the metal rack board are only cut off and are not subject to the bending work applied in conventional rack boards. This cut off end is fittingly inserted into the gaps defined by the upper horizontal portion projecting from the upper end brim of the vertical portion of the plastic side cover and by the respective upper end brims of the side bracket portions projecting from the front and rear brims of the vertical portion, and the channel-type bracket portions and vertical ribs projecting from and extending between the vertical portion and the lower horizontal portion. A the front and rear vertical bent portions of the main rack board are held by the lower horizontal portion, and the channel-type reinforcing members disposed on the bottom of the main rack board are fittingly connected to the channel-type bracket portion. Thus the plastic side cover is readily attached to the right and left brims of the main horizontal plate without any play in back and forth and up and down direction.

Further, according to this arrangement, the channel-type bracket portions and the side bracket portions projecting from the front and rear brims of the vertical portion of the side cover are respectively fixed to the channel-type reinforcing members and the front and rear vertical bent portions of the main rack board, so that the side cover is rigidly fixed to the main rack board against any movement in horizontal and vertical directions. Additionally, in this case, the above vertical ribs reinforces the side cover and act to nip the cut off end of the main horizontal plate of the main rack board. The channel-type reinforcement members disposed on the bottom side of the main horizontal plate act as an attachment member for the side cover.

Thus, the invention has a main rack board comprising a main horizontal plate which is only cut off at the right and left end portions without forming bent portions thereon and is provided with plastic side covers. Accordingly, the invention enables the simplification of manufacturing process, the reduction of manufacturing costs and the effective designing performed by properly selecting forms, patterns and colors of the side cover.

DESCRIPTION OF THE PREFERRED EMBODIMENT

Figure 1:
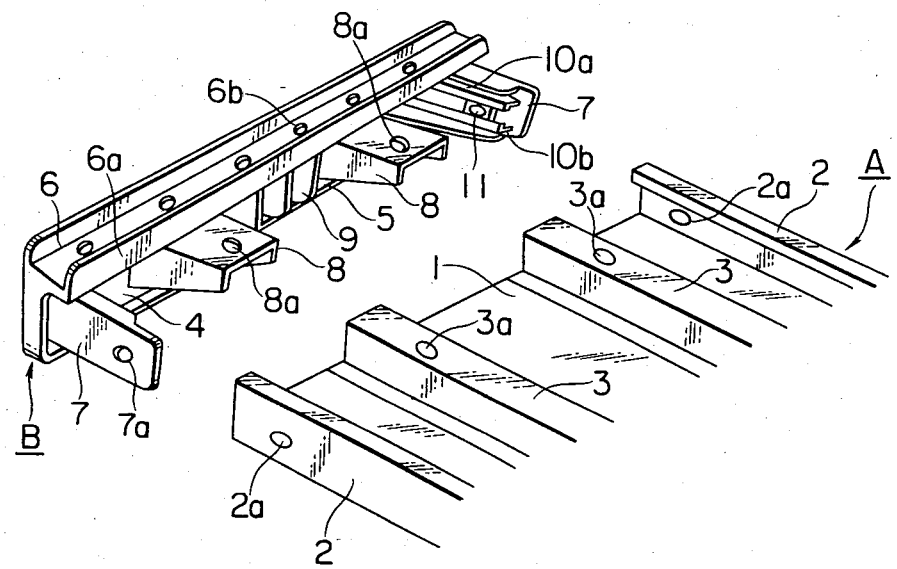
FIG. 1 is an exploded end perspective view of the bottom of a rack board embodying the concept of the present invention.
Figure 2:
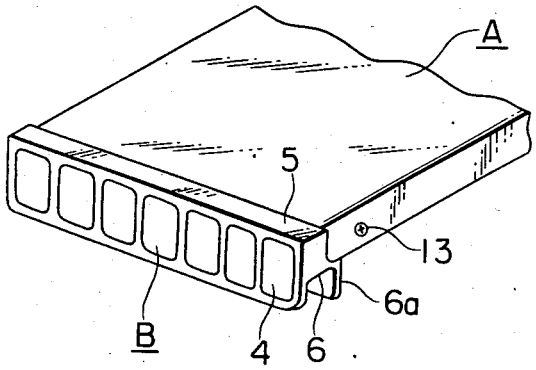
FIG. 2 is an end perspective view of the rack board of FIG. 1.
Figure 3:
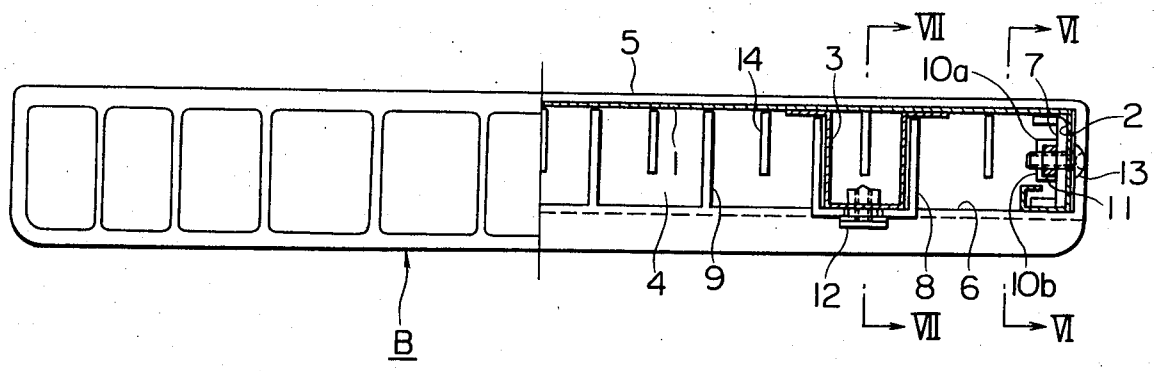
FIG. 3 is a of the end portion of the rack board cut away view.
Figure 4:
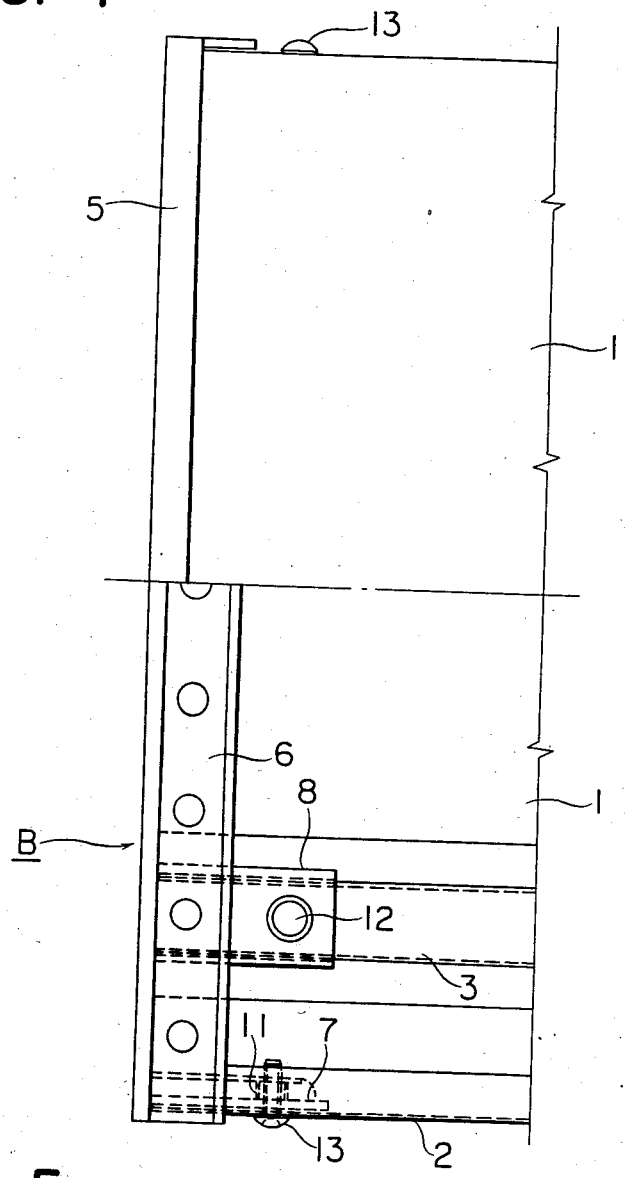
FIG. 4 is plan view of the end portion of the rack board.
Figure 5:
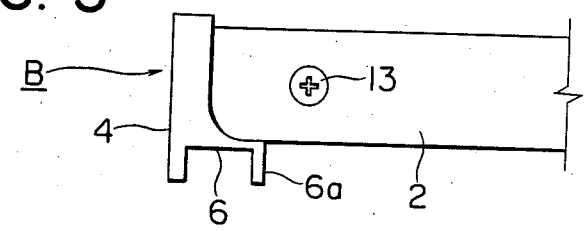
FIG. 5 is a front view of the end portion of the rack board.
Figure 6:
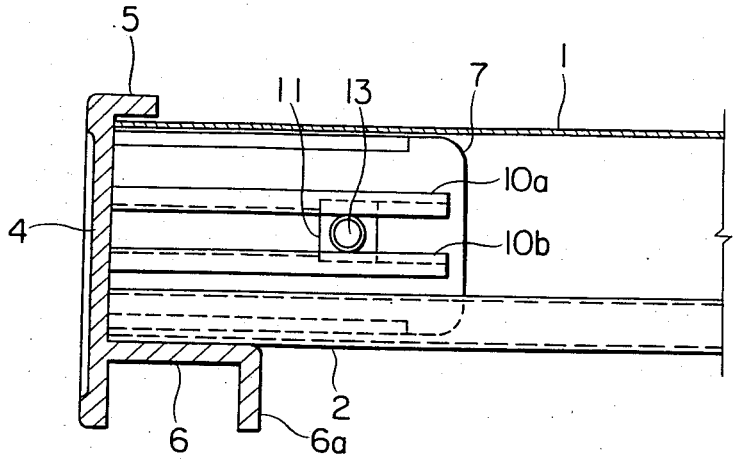
FIG. 6 and FIG. 7 respectively are a cross-sectional view along section lines VI—VI of FIG. 3 and a cross-sectional view along sectional lines VII—VII of FIG. 3.
Figure 7:
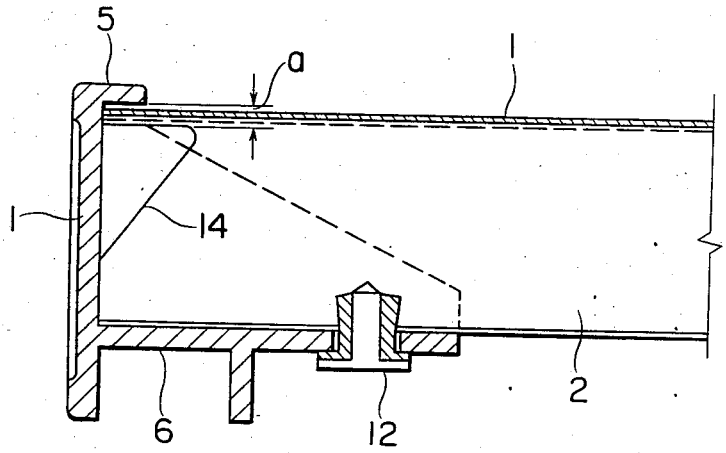

The invention will be described hereinafter with respect to one embodiment of the invention shown in accompanying drawings.

Reference letter A denotes a metal main rack board wherein a horizontal main plate 1 having both ends cut off is provided with vertical bent portions 2 formed on both the front and rear end brims. A pair of channel-type reinforcing members 3 are bonded to the bottom side of the main board, extending toward the right and left sides thereof.

Reference letter B denotes a plastic side cover which is provided with upper and lower horizontal portions 5, 6 respectively projecting from the upper and lower ends of vertical portion 4. Additionally, in the embodiment shown in the Figures, a bent end portion **6*a* of the lower horizontal portion 6 and the vertical portion 4 form a channel-type portion and plurality of through holes 6*b* are bored in the lower horizontal portion 6** in order to reduce the weight thereof.

Horizontal side bracket portions 7 are provided in the side cover and project from the front and rear brims of the vertical portion 4. A pair of channel-type bracket portions 8 project from the extend between the lower horizontal portion 6 and the vertical portion 4. Ribs 9 project and are located between these bracket portions 8 and between and the side bracket portions 7. Gaps exist between the upper horizontal portion 5 and the respective upper end brims of the side bracket portions 7, the channel-type bracket portions 8 and the ribs 9.

Attachment holes 8*a*, 3*a* are bored and correspondingly positioned in respective bottom portions of the channel-type bracket portion 8 and the channel-type reinforcing member 3. A pair of upper and lower horizontal strips 10*a*, 10*b* project inwardly from the side bracket portion 7. A nut 11 aligned with the attachment hole 7*a* of the side bracket portion 7 is set between the pair of horizontal strips 10*a*, 10*b*. Further, attachment holes 2*a* are bored and positioned in the front and rear vertical attachment portions 2 such that the attachment holes 2*a* respectively correspond to the attachment holes 7*a*.

The cut off end of the main horizontal plate of the main rack board A is fittingly inserted into the gaps formed between the upper horizontal portion 5 and the respective upper end brims of the side bracket portions 7, the channel-type bracket portions 8 and the ribs 9, while the channel-type reinforcing members 3 are fittingly connected to the channel-type bracket portions 8. The front and rear vertical bent portions 2 are placed on the lower horizontal portion. Further, through the respective attachment holes of the channel-type bracket portion 8 and the channel-type reinforcing member 3 fasteners 12 are provided. A bolt 13 is passed through the attachment hole 7*a* of the side bracket portion 7 and tightened by the nut 11. Thus, the plastic-made side covers B are respectively attached and fixed to the right and left end portions of the metal main rack board A.

The reference number 14 denotes auxiliary ribs disposed between adjacent ribs 9.

Thus, according to the embodiment shown in the Figures, the main rack board A is provided with a main horizontal plate 1 with the right and left end portions cut off to which plastic side covers B are firmly attached in a simplified manner. Thus, the work for bending the right and left sides of the main rack board is omitted, manufacturing process is simplified and the reduction of manufacturing cost is achieved. It is possible for the side cover to be changed in form, color and pattern and to be effectively designed in various manners.

The invention has been described by referring to the preferred embodiment but is not limited to this embodiment. It will be understood that modifications of design may be made therein without departing from the spirit of the invention.

What is claimed is:

1. A rack board comprising:

a metal plate having front and rear sides and right and left edge sides, said front and rear sides each comprised of a respective front and rear plate section extending transverse to said metal plate, a fastening hole disposed on ends of said front and rear plate sections at said right and left edge sides, said right and left edge sides each consisting of a respective edge extending along said metal plate and said front and rear plate sections;

plastic side covers for covering said left and right edge sides, said plastic covers each comprised of upper and lower horizontal portions extending along said right and left edge sides and disposed in planes parallel to said metal plate, a vertical section extending between and transverse to said upper and lower horizontal portions, front and rear vertical portions extending between said upper and lower horizontal portions at the ends of said upper and lower horizontal portions and disposed in planes parallel with said front and rear plate sections, and first side bracket means attached to said vertical section and spaced from said front vertical portion and said upper horizontal portion and second side bracket means attached to said vertical section and spaced from said rear vertical portion and said upper horizontal portion, said side bracket means projecting towards said metal plate, said side bracket means each having a fastening hole for aligning with a respective said fastening hole of said front and rear plate sections for receiving a fastener to attach said side covers to said metal plate, said ends of said front and rear plate sections extending between said bracket means and said front and rear vertical portions respectively, said plate means extending between said side bracket means and said upper horizontal portion.

2. A rack board as claimed in claim 1 further comprising;

reinforcing channel members attached to said metal plate and extending between said right and left side edges;

said side covers having channel bracket means between said front and rear vertical portions and spaced from said upper horizontal portion and projecting from said vertical section towards said metal plate for engaging said reinforcing channel members, each of said channel bracket means having a fastening hole extending therethrough, said reinforcing channel members each having a fastening hole therethrough for aligning with the fastening hole of said channel bracket means for receiving a fastener to further fasten said side covers to said metal plate, said metal plate extending between said channel bracket means and said upper horizontal portion.

3. A rack board as claimed in claim 1 wherein, said side covers further comprise vertical ribs between said front and rear vertical portions and spaced from said upper horizontal portion and extending from said vertical section towards said metal plate for reinforcing said side covers, said metal plate extending between said vertical ribs and said upper horizontal portion.

4. A rack board as claimed in claim 1 wherein, each of said side bracket means has a pair of channels, a nut held between said pair of channels and positioned in alignment with said fastening hole of said side bracket means for receiving the fastener.

* * * * *